US006412505B1

(12) United States Patent
Kaiser

(10) Patent No.: US 6,412,505 B1
(45) Date of Patent: Jul. 2, 2002

(54) IN-ROOM UMBRELLA DISPENSER

(76) Inventor: Joshua D. Kaiser, 1491 First Ave., Suite 4-RS, New York, NY (US) 10021

( * ) Notice: Subject to any disclaimer, the term of this patent is extended or adjusted under 35 U.S.C. 154(b) by 0 days.

(21) Appl. No.: 09/620,879

(22) Filed: Jul. 21, 2000

(51) Int. Cl.[7] ..... E04H 15/36

(52) U.S. Cl. ..... 135/16; D3/5; D3/12; D6/416

(58) Field of Search ..... 135/16, 34.2, 19.5; 248/311.3, 317, 309.1; 705/16

(56) References Cited

U.S. PATENT DOCUMENTS

| | | | |
|---|---|---|---|
| 4,008,874 A | 2/1977 | Conway, Jr. | |
| 4,261,494 A | 4/1981 | Thomas | |
| 4,616,868 A | 10/1986 | Okuda | |
| 4,624,276 A | 11/1986 | Allen | |
| 4,887,786 A | 12/1989 | Stokes | |
| 4,907,614 A | 3/1990 | Stamm | |
| D309,372 S | 7/1990 | Cain | |
| D309,825 S | 8/1990 | Cain | |
| D310,599 S | 9/1990 | Cain | |
| D312,348 S | 11/1990 | Cain | |
| D313,309 S | 1/1991 | Cain | |
| 5,004,122 A | 4/1991 | Poynter | |
| D316,630 S | 5/1991 | Cain | |
| D317,975 S | 7/1991 | Cain | |
| D332,710 S | 1/1993 | Magnusson et al. | |
| 5,261,541 A | 11/1993 | Li | |
| 5,411,237 A | 5/1995 | Dougherty | |
| D368,811 S | 4/1996 | Reese | |
| 5,676,290 A | 10/1997 | Liu | |
| 5,715,954 A | 2/1998 | Zaremba | |
| D403,881 S | 1/1999 | Lucas | |
| 5,934,634 A | 8/1999 | Lindblom | |
| 5,961,015 A | 10/1999 | Shirakawa | |
| 6,032,917 A | 3/2000 | Shannon | |
| 6,052,868 A | 4/2000 | Chen | |
| 6,065,233 A | 5/2000 | Rink | |
| 6,082,694 A | 7/2000 | Joyce | |
| D433,223 S | * 11/2000 | Lippincott | D3/5 |

* cited by examiner

*Primary Examiner*—Carl D. Friedman
*Assistant Examiner*—Steve Varner
(74) *Attorney, Agent, or Firm*—Knobbe, Martens, Olson & Bear, LLP

(57) ABSTRACT

An umbrella dispensing system is used in hotels to make umbrellas accessible to guests. The system combines a dispensing device and at least one umbrella that has a handle formed to receive a breakable seal. The dispensing device is mounted on a closet bar or on an optional wall-mounting adapter. The dispensing device and the umbrella handle have respective holes that are aligned when the umbrella is mounted in the dispensing device. The seal is preferably constructed from polypropylene or another suitable material, and is threaded through both holes to lock the umbrella in place. When the umbrella is removed, the seal is broken, indicating to staff that the umbrella has been used whereby a discretionary charge can be placed on the guest's room bill. The integrated components permit a hotel to make umbrellas accessible to guests in each guestroom and to determine when the umbrella is taken or used so that a guest can be charged for the use of the umbrella.

33 Claims, 5 Drawing Sheets

IN-ROOM UMBRELLA DISPENSER

BACKGROUND OF THE INVENTION

1. Field of the Invention

The present invention relates to an apparatus installed in hotels and other facilities to provide umbrellas to guests.

2. Description of the Related Art

Hotel guests who commonly travel for business or leisure frequently have occasions to wear fine clothing, such as expensive business suits or delicate eveningwear. Many travel destinations have inclement weather, such as rain or other precipitation. With morning meetings, evening theatre, and other events to attend, unexpected rain or other precipitation causes an instant demand and necessity for an umbrella.

While some travelers pack collapsible umbrellas, most recognize the inefficiency that small and flimsy collapsible models tend to share in common. Yet standard stick-style umbrellas span 35 inches in length and thus fit in few, if any, garment bags or suit cases. This situation renders the majority of travelers unprepared for wet weather conditions. Thus, guests frequently expect hotels to provide a remedy.

While some hotels (mostly small, luxury properties) provide umbrellas to guests free of charge, the vast majority of corporate brand chains are unwilling to assume the cost involved to provide umbrellas as a service.

There is currently no known system for offering umbrellas in simple and cost-effective manner. Certainly, umbrellas are commonly available for purchase, and are often available within a hotel through leased gift or sundry shops. However, the art has not developed significantly in providing devices that make umbrellas accessible to guests within each guestroom in a vending, self-service fashion. Moreover, the art does not provide an integrated system that uses both a dispensing device and a specialized umbrella that compliment one another. It is a shortcoming in the art that few devices permit umbrellas to be offered through this industrious approach.

SUMMARY OF THE INVENTION

The present invention relates to an easily installed dispenser, commonly mounted to the closet bar within the closet of a hotel guestroom. The dispenser permits an umbrella to be stocked and made accessible to guests.

Additionally, the present invention relates to umbrellas of varying styles and sizes, each umbrella having a uniquely modified handle which creates the condition of required compatibility between the dispenser and the product that is dispensed.

Accordingly, one general object of the present invention is to provide a device in which umbrellas can be made accessible to hotel guests conveniently within the guestroom.

An additional object of the present invention is to provide a device that permits umbrellas to be sold in a self-service, vending method.

Another object of the present invention is to provide a dispensing device with flexibility to stock a range of different umbrella styles as long as they possess the required compatible handle style.

Still another object of the present invention is to provide an area upon the dispenser where signage can be affixed to encourage the use of the dispenser and to explain the guidelines for purchase of an umbrella from the dispenser.

Moreover, another object of the present invention is to provide an alternative option to closet mounting by providing a wall-mount adapter. The wall-mount adapter permits the dispenser to be installed at discretionary heights on nearly any vertical surface. When mounted at lower heights, persons of shorter stature and persons confined to a wheelchair can have ready access to use the system.

An additional object of this invention is to consume minimal closet bar space when mounted within the closet, thus leaving ample room for garments and other hotel amenities such as bathrobes and laundry bags.

Yet another object of this invention is to notify an hotelier when an umbrella placed within the guestroom has been used.

BRIEF DESCRIPTION OF THE DRAWINGS

The foregoing objects and other objects of the present invention will become apparent from a detailed description of the present invention, which follows in conjunction with accompanying drawings, in which.

DETAILED DESCRIPTION OF THE PREFERRED EMBODIMENT

Figure 1:
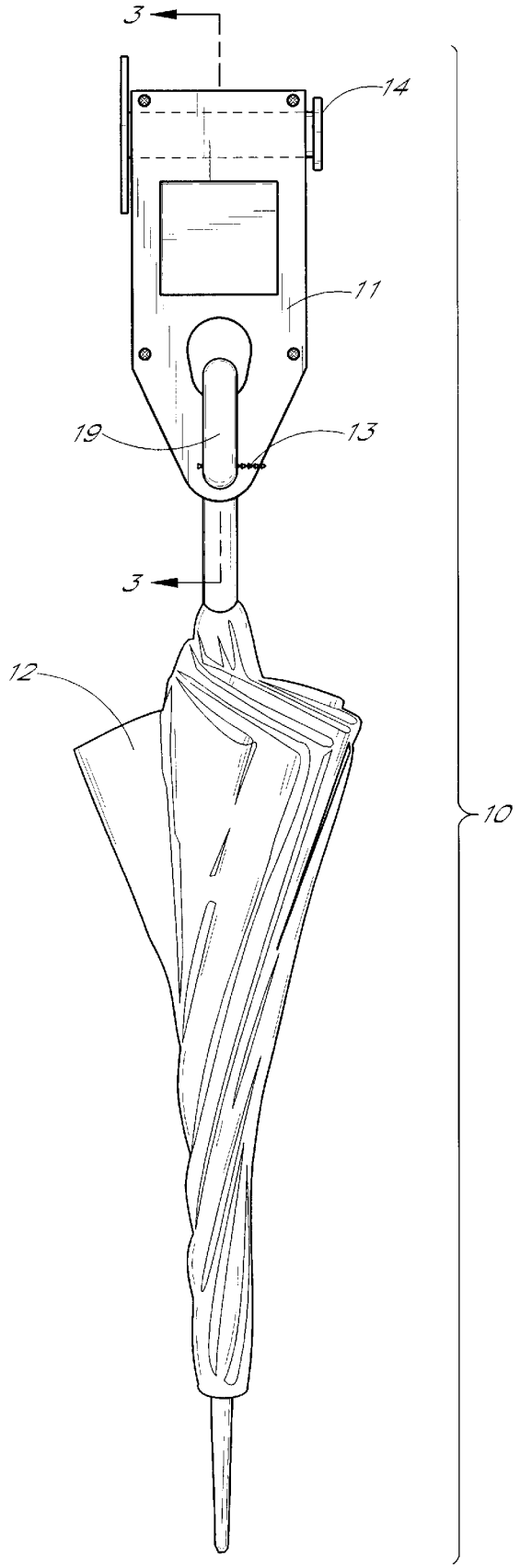
FIG. 1 illustrates a front view of a complete umbrella dispensing system in accordance with the present invention, showing the umbrella installed in the dispenser.

FIG. 1 is a perspective front view of an umbrella dispensing system 10 according to the invention. The system comprises a dispenser 11, a compatible umbrella 12 and a seal 13. The system 10 may advantageously include an optional wall-mount adapter 14 (shown in FIG. 5) for use when a closet bar is not available or when mounting in a different location or at a different level is desired. The umbrella 12 comprises a foldable canopy mounted on a central pole. The central pole has a U-shaped handle 19 at an end opposite the canopy.

Figure 2:
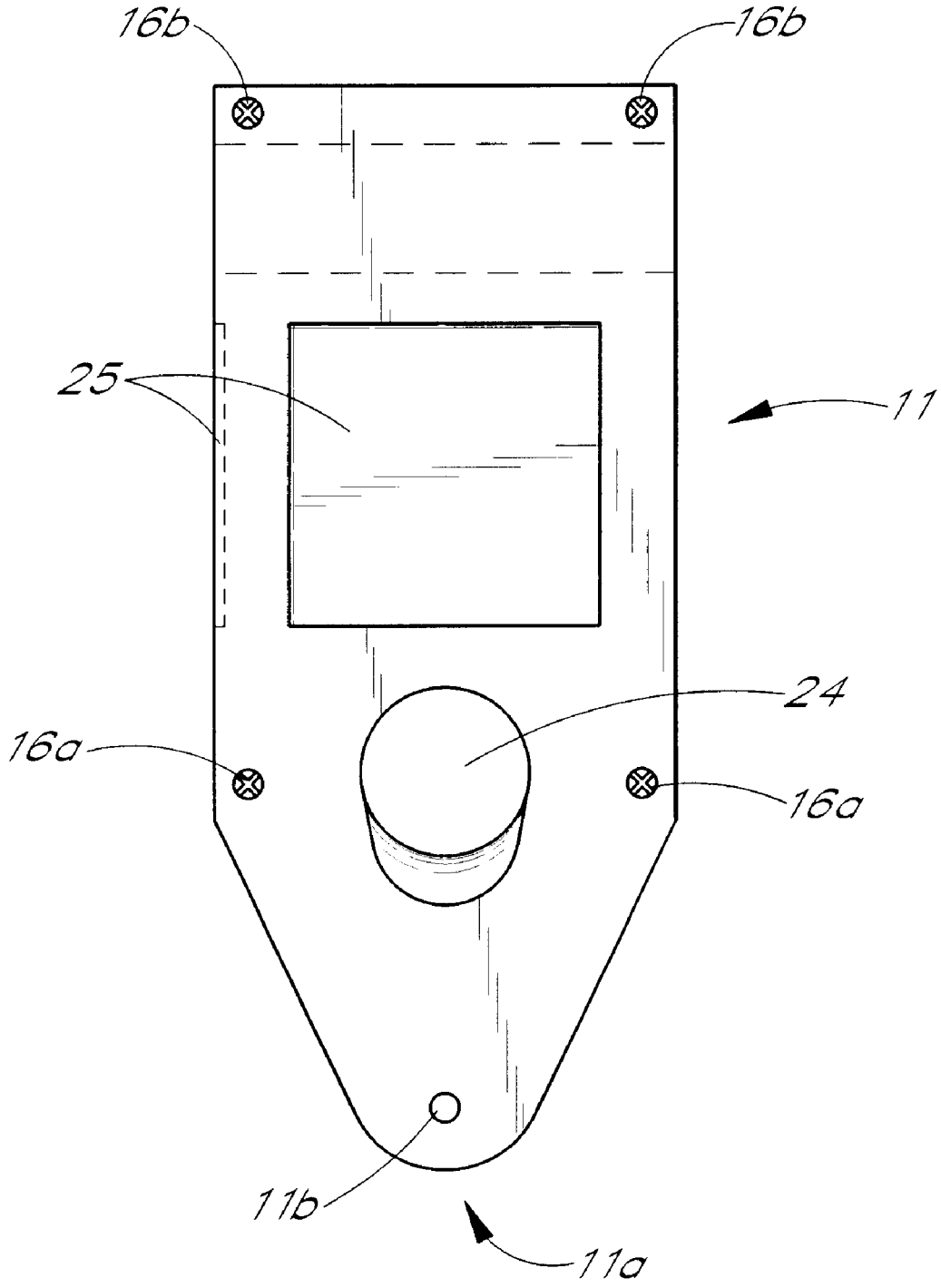
FIG. 2 illustrates a front view of a particularly preferred embodiment of the dispenser of the present invention.

As shown in FIG. 2, the dispenser 11 includes a body portion terminating at a bottom portion 11*a*. The bottom portion 11*a* has a shape that permits a hole 11*b* to be formed therein through which the seal 13 (shown in FIG. 7) is threaded.

A larger hole 24 is positioned above the smaller hole 11*b* to form a cradle. The cradle 24 receives the U-shaped umbrella handle 19 (see FIG. 1) to thereby hook the umbrella 12 onto the dispenser 11 so that the umbrella 12 hangs vertically below the dispenser 11.

As discussed below in connection with FIG. 6, the umbrella handle 19 includes a hole 20 proximate to its termination end. The cradle 24 is positioned so that when the handle 19 of the umbrella 12 is fed into the dispenser 11 from the back side, the hole 20 in the emerging umbrella handle 19 lines up with the seal hole 11*b* of the dispenser 11.

The front face and one side of the dispenser 11 have recessed areas 25 that receive adhesive signage for explaining the operation of the dispenser 11 to a user and for setting forth the conditions of use (i.e., the charge for using or taking the umbrella). When mounted to a closet bar, the signage is applied to the front recessed area of the dispenser 11 so that it can be viewed from the entry to the closet. When the dispenser 11 is used in conjunction with the wall-mount adapter 14, the signage may be applied either to the side recessed area or the front recessed area in accordance with the intended positioning of the dispenser 11 with respect to the likely position of the user.

Figure 3:
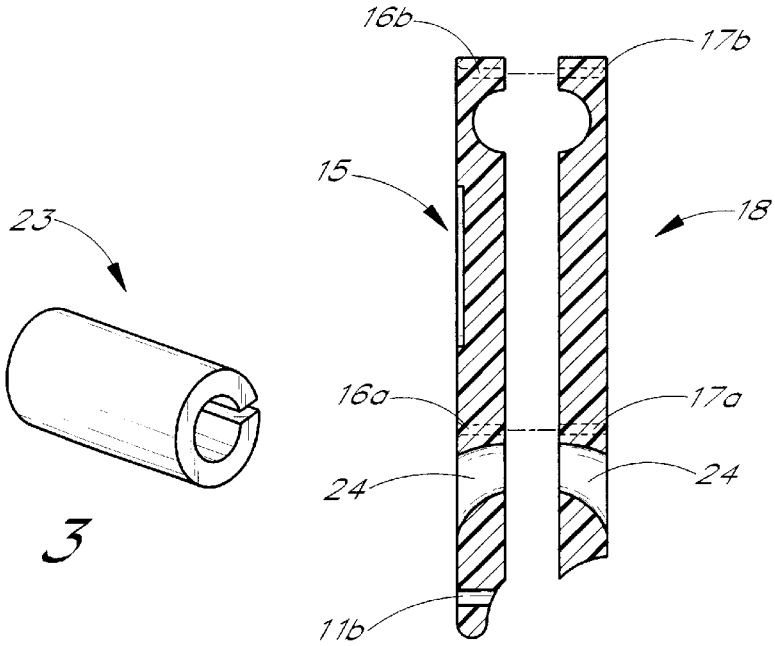
FIG. 3 illustrates a cross-sectional side view of the dispenser of FIG. 2 taken along the lines 3—3 in FIG. 2, and further illustrates a foam-rubber grommet used in the installation of the dispenser.

The dispenser 11 shown in FIG. 3 preferably comprises a front plastic section and a back section 18, each having a hemispherical void therein. When the dispenser 11 is installed on a closet bar 21 (FIG. 4) or on the wall-mount adapter 14, the front section 15 is fastened to the back section 19 with the closet bar 21 or the protruding arm 22 of the wall-mount adapter 14 positioned in the voids. Self-tapping screws pass through ports 16*a* & 16*b* in the front section 15 and engage receptacles 17*a* & 17*b* in the back section 18 to hold the two sections 15, 18 together.

Prior to installation of the dispenser 11, a resilient insert 23, such as an insert formed from foam rubber or the like, is fitted over either the closet bar 21 or the protruding arm 22 of the wall-mount adapter 14. The resilient nature of the foam rubber insert 23 permits the dispenser 11 to be used with a variety of closet bar sizes or with the protruding arm 22. The insert 23 is forcefully compressed as the self-tapping screws draw the front member 15 and the back member 18 together so that the dispenser 11 is securely mounted and is resistant to rotation on the closet bar 21 or the protruding arm 22. A hemispherical flange 26 is located on both sides of the mounting rod voids in the front section 15 and the rear section 18. The flanges 26 prevent the foam-rubber insert 23 from moving out either end when the front section 15 and the rear section 18 are forced together over the closet rod 21 or the protruding arm 22 of the wall-mount adapter 14.

Both the front member 15 and the back member 18 preferably comprise a high-impact plastic that is strong and resilient to wear and that is aesthetically pleasing and able to be dyed in a variety of colors. While plastic is preferred, alternative materials for fabrication such as wood or metal can also be advantageously used.

Figure 4:
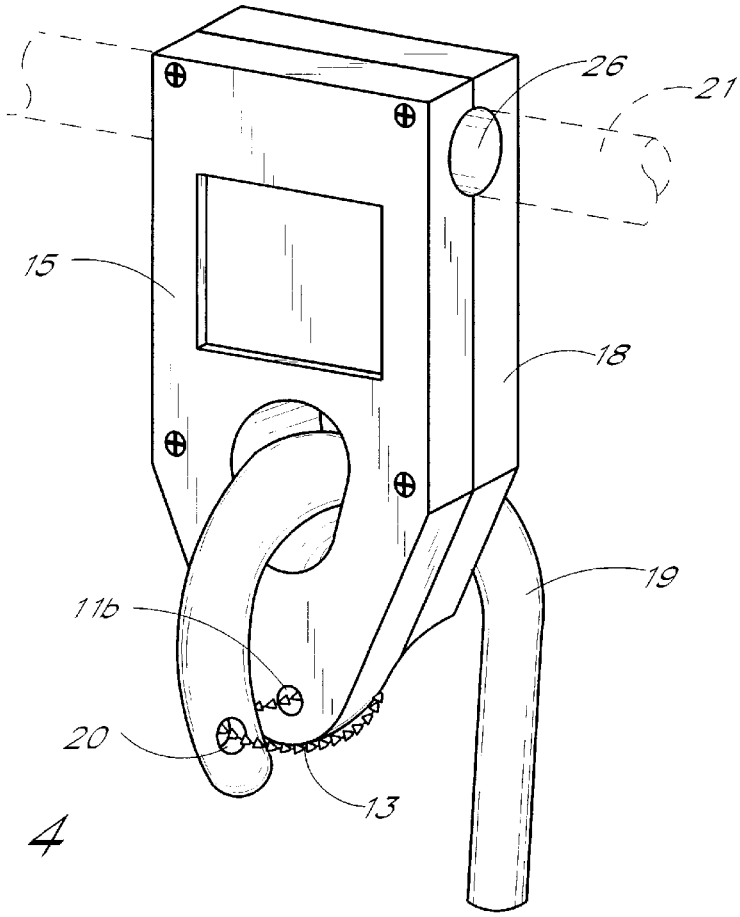
FIG. 4 illustrates a perspective side view of the dispenser loaded with a compatible umbrella handle, wherein the umbrella is secured to the dispenser using a seal in accordance with another aspect of the present invention.

The dispenser 11 shown in FIG. 2 functions as a device for placing an umbrella in hotel guest rooms for dispensation to guests. As best seen in FIG. 4, each in-room dispenser 11 supports the umbrella 12 that has the custom handle 19 that includes the horizontally drilled hole 20.

Figure 6:
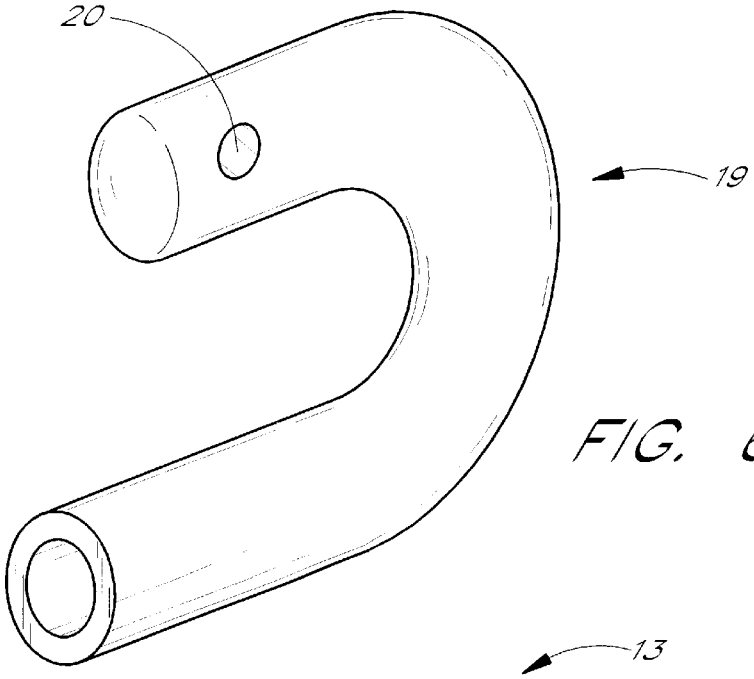
FIG. 6 illustrates an umbrella handle adapted for use with the dispenser, the umbrella handle including an accurately placed hole to enable the umbrella handle to be sealed to the dispenser.

In order to operate with the dispenser 11, the umbrella handle 19, shown in FIG. 4 and shown more closely in FIG. 6, includes the horizontal hole 20, which is either drilled or pre-molded into the material from which the handle 19 is crafted. In the preferred embodiment, the hole 20 has a diameter of approximately ⅛ inch or 3 mm. The hole 20 extends through the handle 19. The diameter of the hole 20 provides ample space through which to feed the seal 13 while maintaining enough material on either side of the hole 20 to ensure handle strength. The strength of the handle 19 enables a guest to break the seal 13 and remove the umbrella 12 from the dispenser 11.

As indicated in FIG. 4, the umbrella 12 is inserted into the cradle 24 of the dispenser 11 from the rear of the dispenser 11. The seal 13 is threaded through the hole 20 in the umbrella handle 19 and through the seal hole 11*b* of the dispenser 11. When the user approaches the system 10, the user's perspective will be the view illustrated in FIG. 1. The signage in the selected recessed area 25 of the dispenser 11 instructs the user to grasp the hanging canopy portion of the umbrella 12 and pull the umbrella toward the user. This action produces a lever-like movement in which the umbrella handle 19 rolls easily over the dispenser cradle 24 creating tension on the seal 13. By continuing to apply force, the user is able to snap the seal 13 with relative ease and remove the umbrella.

Figure 5:
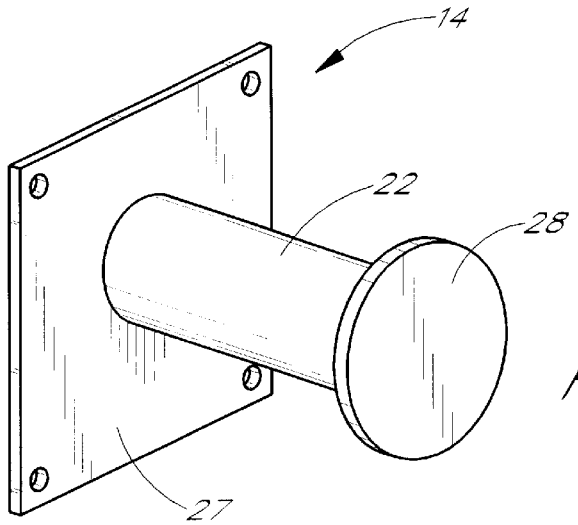
FIG. 5 illustrates a wall-mount adapter used as an alternative to closet bar mounting of the dispenser.

The wall-mount adapter 14 shown in FIG. 5 permits the dispenser 11 to be mounted to nearly any vertical surface. When installed at low heights, the adapter 14 provides access to the dispenser 11 by those confined to a wheelchair or having short stature. The adapter 14 comprises a square metal back plate 27, which contains a screw hole at each of the four corners. Screws are fastened through these holes into the vertical mounting surface, using anchors when necessary. The arm 22 protrudes from the back plate 27. The arm 22 is a cylinder-shaped rod having a length approximately the same as the width of the dispenser 11. The arm 22 substitutes for the closet bar in alternative applications. The dispenser 11 is installed on the arm 22 using the foam-rubber insert 23 as discussed above. The arm 22 can be hollow, in which case, the arm 22 is terminated with a cap whose radius exceeds the radius of the arm 22. The cap prevents the dispenser 11 from sliding off the arm 22. The wall-mount adapter 14 is preferably manufactured from a metal material, which is advantageously reflective in appearance to resemble chrome for aesthetic purposes.

Figure 7:
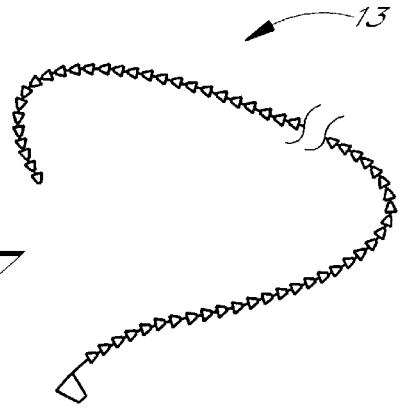
FIG. 7 illustrates a breakable polypropylene seal strip to interconnect the umbrella handle and the dispenser, until a guest removes the umbrella.

As shown in FIG. 7, the seal 13 advantageously comprises a length of polypropylene or another flexible plastic. The seal 13 is advantageously formed into a plurality of larger diameter beads interconnected by smaller diameter portions of plastic. The seal 13 has first male end and a second female end. When used, the seal 13 is first threaded though the hole 11*b* in the dispenser 11 and through the hole 20 in the handle 19 of the umbrella 12. The male end of the seal 13 is then inserted into the female end to form a continuous loop, thus binding the umbrella 12 to the dispenser 11. The female end includes a non-reversible latching mechanism so that the male end cannot be removed once the male end has been inserted into the female end. Thus, the only way that the umbrella 12 can be removed from the dispenser 11 is to break the seal 13, as described above. The smaller diameter portions of the seal 13 are interposed with the larger diameter beads to make the seal easier to break.

It should be appreciated that the present invention can be used to enable a hotel guest to use the umbrella 12 and keep the umbrella, in which case the guest will be charged a predetermined price for the umbrella 12, as shown on the signage applied to the dispenser 11. In the alternative, the guest may be informed that the umbrella 12 may be used on a temporary basis and returned to the dispenser 11. In the alternative case, the guest will be charged a lower amount for the use. Although the guest may return the umbrella 12, the broken seal 13 indicates to the hotel that the umbrella 12 has been removed, and the guest is charged accordingly.

The umbrella 12 may be configured in many different designs and may advantageously include a logo or other indication of the hotel from which the umbrella was borrowed or purchased.

Figure 8:
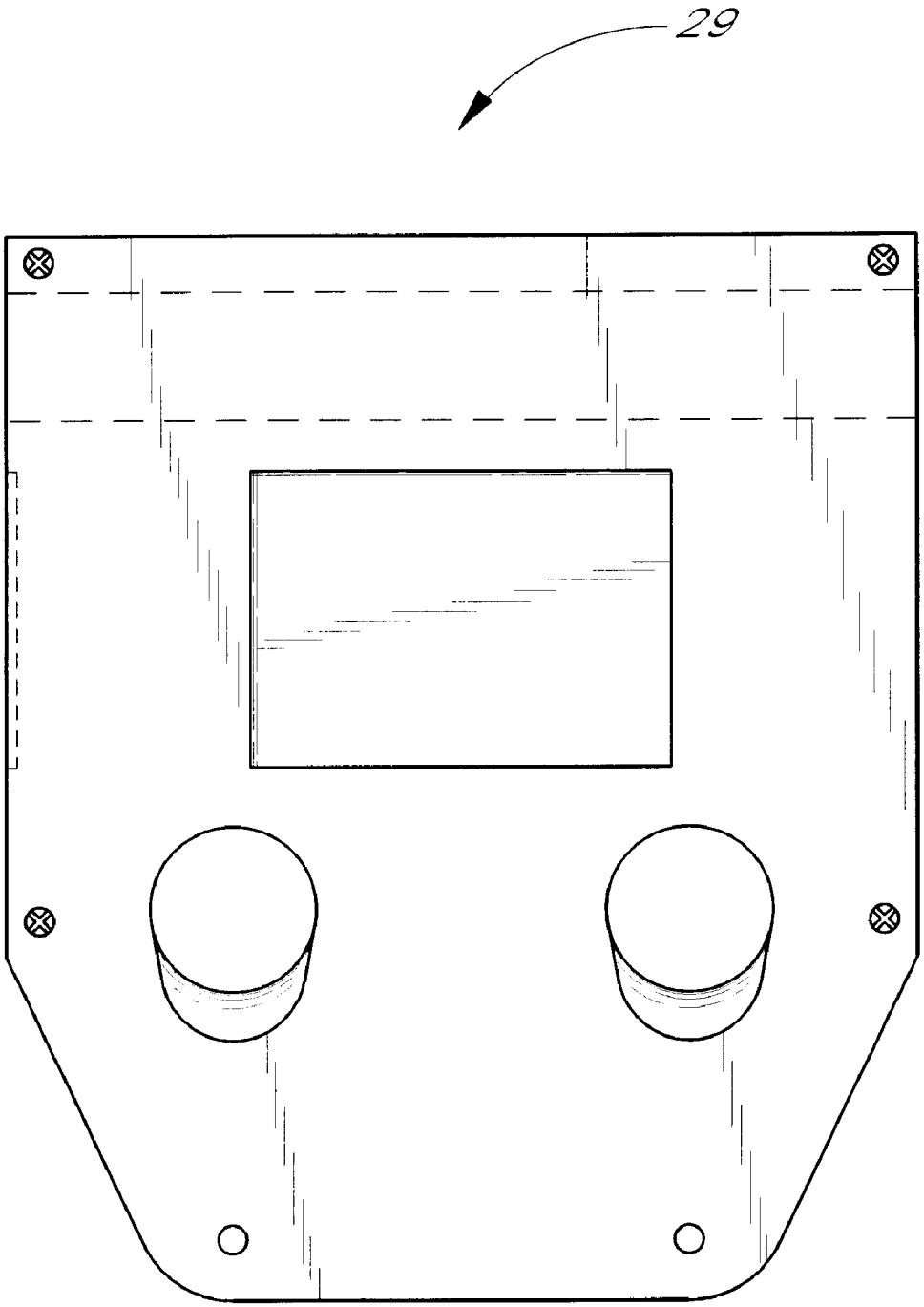
FIG. 8 illustrates a front view of an alternative embodiment of the dispenser of the present invention, which has cradles to accommodate two umbrellas.

FIG. 8 illustrates a front view of an alternative embodiment of a dispenser 29, which has cradles to accommodate two umbrellas. The umbrellas (not shown) may be identical. Alternatively, the umbrellas may be different (e.g., different sizes, different styles, different colors, or the like) to provide the guest with a choice of umbrellas.

It will be clearly understood by those skilled in the art that the foregoing description has been made in terms of the preferred embodiments. Various changes and modifications may be made from the preferred embodiments without departing from the scope of the present invention, which is defined by the appended claims.

I claim:

1. A system for dispensing umbrellas to hotel guests, comprising:

a dispenser having at least one cradle formed therein, wherein the dispenser is mounted to a closet rod;

a least one umbrella to be dispensed, the umbrella having a center pole, a collapsible canopy mounted to one end of the center pole, and a handle mounted to a second end of the center pole, the handle fitting within the cradle of the dispenser; and a breakable seal that interconnects the handle of the umbrella and the dispenser when the handle of the umbrella is positioned within the cradle of the dispenser, the seal being oriented to break and release the umbrella when pressure is applied to the center pole of the umbrella.

2. The system as defined in claim 1, wherein the dispenser comprises first and second sections, and wherein the first section is fastened to the second section with the closet rod securely clamped between the two sections.

3. The system as defined in claim 2, further comprising a resilient insert positionable over the closet rod between the first and second sections to inhibit movement of the dispenser with respect to the closet rod.

4. The system as defined in claim 3, wherein the first section and the second section have respective voids formed therein to receive the closet rod, and wherein the first and second sections have flanges proximate to the voids to retain the resilient insert when the first and second sections are clamped together.

5. The system as defined in claim 1, wherein the presence of a broken seal indicates that an umbrella has been removed from the dispenser so that a usage charge can be imposed for removing the umbrella.

6. A system for dispensing umbrellas to hotel guests, comprising:

a dispenser having at least one cradle formed therein, wherein the dispenser is mounted on a wall-mount adapter, the wall-mount adapter being positioned on a wall or other vertical surface at a level selected for ready access by a user;

a least one umbrella to be dispensed, the umbrella having a center pole, a collapsible canopy mounted to one end of the center pole, and a handle mounted to a second end of the center pole, the handle fitting within the cradle of the dispenser; and a breakable seal that interconnects the handle of the umbrella and the dispenser when the handle of the umbrella is positioned within the cradle of the dispenser, the seal being oriented to break and release the umbrella when pressure is applied to the center pole of the umbrella.

7. The system as defined in claim 6, wherein the wall-mount adapter comprises a rod positioned perpendicularly to the wall or other vertical surface, and wherein the dispenser is clamped to the rod.

8. The system as defined in claim 7, wherein the rod has a first radius and wherein the rod is terminated with a cap having a second radius larger the first radius to secure the dispenser on the rod.

9. The system as defined in claim 6, wherein the handle of the umbrella has a hole formed therein to receive the breakable seal.

10. The system as defined in claim 9, wherein the dispenser has a hole formed therein to receive the breakable seal, the hole aligned with the hole of the umbrella when the handle of the umbrella is inserted in the cradle of the dispenser.

11. A system for dispensing umbrellas to hotel guests, comprising:

a dispenser having at least one cradle formed therein;

a least one umbrella to be dispensed, the umbrella having a center pole, a collapsible canopy mounted to one end of the center pole, and a handle mounted to a second end of the center pole, the handle fitting within the cradle of the dispenser, wherein the handle of the umbrella has a shape in the form of a U, and wherein the cradle of the dispenser is U-shaped to conform to the shape of the handle; and a breakable seal that interconnects the handle of the umbrella and the dispenser when the handle of the umbrella is positioned within the cradle of the dispenser, the seal being oriented to break and release the umbrella when pressure is applied to the center pole of the umbrella.

12. The system as defined in claim 11, wherein the dispenser includes a recessed area in at least one surface to receive an adhesive sign.

13. The system as defined in claim 11, wherein the dispenser has a hole formed therein to receive the seal.

14. The system as defined in claim 13, wherein the handle of the umbrella has a hole formed therein to receive the breakable seal, and wherein the hole in the handle of the umbrella is aligned with the hole in the dispenser when the handle of the umbrella is inserted in the cradle of the dispenser.

15. The system as defined in claim 11, wherein the breakable seal comprises plastic.

16. The system as defined in claim 11, wherein the breakable seal comprises a length of plastic having a male end and a female end, and wherein the seal is formed into a continuous loop, after threading the seal through the hole in the umbrella handle and the hole in the dispenser, by inserting the male end into the female end, the female end being a one-way device that prevents the inserted male end from being removed unless the seal is broken.

17. The system as defined in claim 16, wherein the seal comprises polypropylene.

18. The system as defined in claim 11, wherein the dispenser has at least two cradles to receive the handles of at least two umbrellas.

19. A method for providing umbrellas to a hotel guest on a self-service basis within a hotel guestroom, the method comprising:

providing a dispenser in the hotel guestroom;

inserting at least one umbrella into the dispenser;

interconnecting the umbrella and the dispenser using a breakable seal, the seal preventing the umbrella from being removed from the dispenser without breaking the seal;

determining that the umbrella has been used by the presence of a broken seal; and charging a guest for using or taking the umbrella.

20. The system as defined in claim 1, the dispenser includes a recessed area in at least one surface to receive an adhesive sign.

21. The system as defined in claim 1, wherein the dispenser has a hole formed therein to receive the breakable seal.

22. The system as defined in claim 21, wherein the handle of the umbrella has a hole formed therein to receive the breakable seal, and wherein the hole in the handle of the umbrella is aligned with the hole in the dispenser when the handle of the umbrella is inserted in the cradle of the dispenser.

23. The system as defined in claim 1, wherein the breakable seal comprises plastic.

24. The system as defined in claim 1, wherein the breakable seal comprises a length of plastic having a male end and a female end, and wherein the seal is formed into a continuous loop, after threading the seal through the hole in the umbrella handle and the hole in the dispenser, by inserting the male end into the female end, the female end being a one-way device that prevents the inserted male end from being removed unless the seal is broken.

25. The system as defined in claim 24, wherein the seal comprises polypropylene.

26. The system as defined in claim 1, wherein the dispenser has at least two cradles to receive the handles of at least two umbrellas.

27. The system as defined in claim 6, wherein the dispenser includes a recessed area in at least one surface to receive an adhesive sign.

28. The system as defined in claim 6, wherein the breakable seal comprises plastic.

29. The system as defined in claim 6, wherein the breakable seal comprises a length of plastic having a male end and a female end, and wherein the seal is formed into a continuous loop, after threading the seal through the hole in the umbrella handle and the hole in the dispenser, by inserting the male end into the female end, the female end being a one-way device that prevents the inserted male end from being removed unless the seal is broken.

30. The system as defined in claim 29, wherein the seal comprises polypropylene.

31. The system as defined in claim 6, wherein the dispenser has at least two cradles to receive the handles of at least two umbrellas.

32. The system as defined in claim 6, wherein the presence of a broken seal indicates that an umbrella has been removed from the dispenser so that a usage charge can be imposed for removing the umbrella.

33. The system as defined in claim 1, wherein the presence of a broken seal indicates that an umbrella has been removed from the dispenser so that a usage charge can be imposed for removing the umbrella.

* * * * *